US005635033A

United States Patent [19]

Grossmann et al.

[11] Patent Number: 5,635,033

[45] Date of Patent: Jun. 3, 1997

[54] PAPER MACHINE FOR THE MANUFACTURE OF A MULTI-LAYER PAPER WEB

[75] Inventors: Udo Grossmann; Dieter Egelhof; Albrecht Meinecke, all of Heidenheim, Germany

[73] Assignee: Voith Sulzer Papiermaschinen GmbH, Germany

[21] Appl. No.: 379,939

[22] Filed: Jan. 27, 1995

[30] Foreign Application Priority Data

Jan. 27, 1994 [DE] Germany ..... 44 02 273.5

[51] Int. Cl.[6] ..... D21F 11/04

[52] U.S. Cl. ..... 162/304; 162/133; 162/190; 162/264; 162/301

[58] Field of Search ..... 162/304, 300, 162/301, 303, 133, 190, 264

[56] References Cited

U.S. PATENT DOCUMENTS

| | | | |
|---|---|---|---|
| 2,488,700 | 11/1949 | Bidwell | 162/304 |
| 4,477,313 | 10/1984 | Andersson | 162/190 |
| 4,830,709 | 5/1989 | Turner et al. | 162/304 |
| 5,045,153 | 9/1991 | Sollinger et al. | 162/301 |
| 5,078,835 | 1/1992 | Schiel et al. | 162/352 |
| 5,389,206 | 2/1995 | Buck et al. | 162/301 |
| 5,427,654 | 6/1995 | Gray et al. | 162/303 |

FOREIGN PATENT DOCUMENTS

| | | | |
|---|---|---|---|
| 0489094 | 7/1991 | European Pat. Off. . | |
| 4031038 | 4/1992 | Germany | 162/304 |

*Primary Examiner*—Karen M. Hastings

*Attorney, Agent, or Firm*—Ostrolenk, Faber, Gerb & Soffen, LLP

[57] ABSTRACT

A paper machine forming section with two wire forming units. One of the two forming units is a twin wire web forming unit having a headbox, two wire loops arranged in sandwich-like manner and a drainage element for each of the wire loops. The first web-forming unit has a first section including a curved suction drainage element or roll in the first lower wire loop; a second section with opposing drainage ledges, wherein the drainage ledges are stationary on the upper side and the drainage ledges are developed resiliently pressable on the bottom side; the drainage ledges of the upper and lower sides are arranged staggered with respect to each other in the direction of travel of the wire, and at least the ledges of the upper side are developed with suction; a third section which has at least one suction wire separating element on one side. The second web-forming unit is a hybrid former with a single wire. The guide rolls for the second wire of the first former and for the wire of the second former guide them on a joint wire path where the multilayer web is transferred to the wire of the second former. There is a headbox associated with the wire of the second former. A respective backwater circuit collects water and materials drained from each of the forming units and returns them to the respective headboxes.

10 Claims, 2 Drawing Sheets

PAPER MACHINE FOR THE MANUFACTURE OF A MULTI-LAYER PAPER WEB

BACKGROUND OF THE INVENTION

The present invention relates to a paper machine for manufacturing a multi-layer paper web, particularly an apparatus for manufacturing of multi-layer fiber webs comprising at least two web-forming units. Such machines are known, for instance, from 1.) German Utility Model G 91 15 632 and 2.) Federal Republic of Germany 40 31 038 A1.

The machines described in each of these publications comprise at least two web-forming units, and at least one of the units has a twin-wire forming zone. The web-forming units can be of various different developments. For example, combinations of a twin-wire former and a hybrid former are possible. The web-forming unit with a twin-wire zone may comprise a former with a preliminary water drainage path followed by a twin-wire zone, as shown, for instance, in Federal Republic of Germany Application OS 31 38 133. The fiber web layers produced with a twin-wire former with a pre-drainage path, however, have enormous two-sidedness due to the one-sided removal of water. With a single-wire pre-drainage path, it is known that the initial formation of the web occurs only in a lower layer of the fiber suspension fed. Therefore, the distribution of the solids in the different layers of the fiber suspension becomes progressively more non-uniform with progressive drainage. At the same time, the upper layer, which initially remains liquid, tends strongly to form clots. Obviously, upon entrance of the pre-drained fiber suspension into the twin-wire zone, the fiber mat which has already formed in the lower layer is already compacted to such an extent that the non-uniform distribution of solids in the twin-wire zone cannot be eliminated. Furthermore, it is either impossible to break up the clots which have previously formed or to only very inadequately do it. The fiber web layer produced thus has different properties on its inner side and its outer side.

SUMMARY OF THE INVENTION

It is an object of the present invention to provide a paper machine having at least two web-forming units which produce a multi-layer paper web having at least one outer side which satisfies the highest possible requirements as to quality, and wherein it is immaterial as to which outer side of the high-quality fiber-web layer is couched together with the other layer or layers of poorer quality.

This object is achieved by the following features. In order to form a fiber web according to the invention, at least two web-forming units produce a respective outer layer of a multi-layer fiber web. One of the two outer layers is produced for instance by a twin-wire former in accordance with Federal Republic of Germany 39 27 597 A1. Such a twin-wire former does not have a single-wire pre-drainage zone and is referred as a so-called gap former. Two-sided drainage in the twin-wire zone begins on a curved drainage element, for instance on a rotating forming cylinder or, preferably even on a curved stationary forming shoe. Further drainage, particularly two-sided drainage, takes placed in the twin-wire zone between ledges which are arranged "zig-zag", and the ledges which rest against the one wire belt are supported resiliently. This produces an extremely great increase in the quality of the finished layer, which satisfies the highest requirements. At the same time, such a twin-wire former is insensitive to changes in the amount of suspension being fed to it and to changes in the drainage behavior of the fiber suspension. Despite the great increase in quality with respect to the formation, relatively good values for the retention of fillers and fines are obtained. With other conventional twin-wire formers, which have been considered at length as prior art in Federal Republic of Germany 39 27 597 A1, it was necessary to constantly note that, with an improvement in the formation, there was always a strong decrease in the retention of the filler and fines content in the finished fiber web. With the invention, the three quality requirements for fiber webs, namely good formation, high content of filler and fines, and little two-sidedness, are satisfied simultaneously. This means specifically that the relatively high content of fillers and fines is now also present uniformly on both sides of the fiber web layer.

The outer, that is at least the second, layer of poorer quality can be produced by means of a hybrid former or else by means of a conventional twin-wire former. A hybrid former is a former having a long section where unilateral preliminary dewatering occurs, and where downstream of the preliminary dewatering section is a section for bilateral dewatering. Thus, a hybrid former is a combination one-wire and two-wire former.

The fiber web, which includes at least two web layers, is produced by couching the two layers. Because a twin-wire former developed for instance in accordance with Federal Republic of Germany 39 27 597 is used for producing an outer layer, it is immaterial which side of the fiber web layer produced in this twin-wire former is couched with another web forming unit which operates, for instance, by means of pre-drainage. In each case, a fiber web is produced which has high quality on one side. The invention comprises separately collecting and conducting the backwater of the two web-forming units to the respective headboxes. As a result, it is possible to return the backwater obtained upon the drainage to the web-forming units without additional expensive treatment or negative effect on the composition of the fiber suspension.

Another advantage of the concept of the invention is that while the twin-wire former used has at least equivalent or even better formation and at least equivalent and frequently better properties of the sheet, such as, for instance, better constancy of the basis-weight profile and less dispersion of the strength values, it also produces a saving in energy, in contrast to hybrid formers.

The twin-wire former in this invention produces a very uniform property of the fiber web. Through suitable development and arrangement of the drainage ledges, and depending on the requirements, the portions of fillers and/or fines can also be displaced to an increased extent toward the outer side. This can improve the adherence to each other of the two layers produced so that the portions of fines are displaced toward the outside of the paper. As a result, an increased number of fibers are present on the inner sides of a two-layer web, which lie against each other. This provides a better "anchoring together" of the layers, and therefore, after the couching, produces better adherence of the two layers.

For producing the other fiber web layer or layers of poorer quality, hybrid formers or other twin-wire formers having traditional pre-drainage paths can, for instance, be used. The combination with separate backwater guidance in accordance with the invention affords the advantage that the drainage fluid obtained with both web-forming units can be returned to the forming units immediately for processing without additional treatment or separation and without impairment of the quality of the individual fiber-web layers.

The invention produces a final fiber web of high quality on one side, with little expense for adaptation to given requirements of use, since no special demands exist as to the association of the twin-wire former with the other web-forming units. Furthermore, it is possible upon the drainage to again feed backwater obtained at the individual web-forming units to their respective headboxes without having to tolerate losses with respect to the quality of the individual layers.

Other features and advantages of the present invention will become apparent from the following description of the invention which refers to the accompanying drawings.

DESCRIPTION OF PREFERRED EMBODIMENTS

Figure 1:
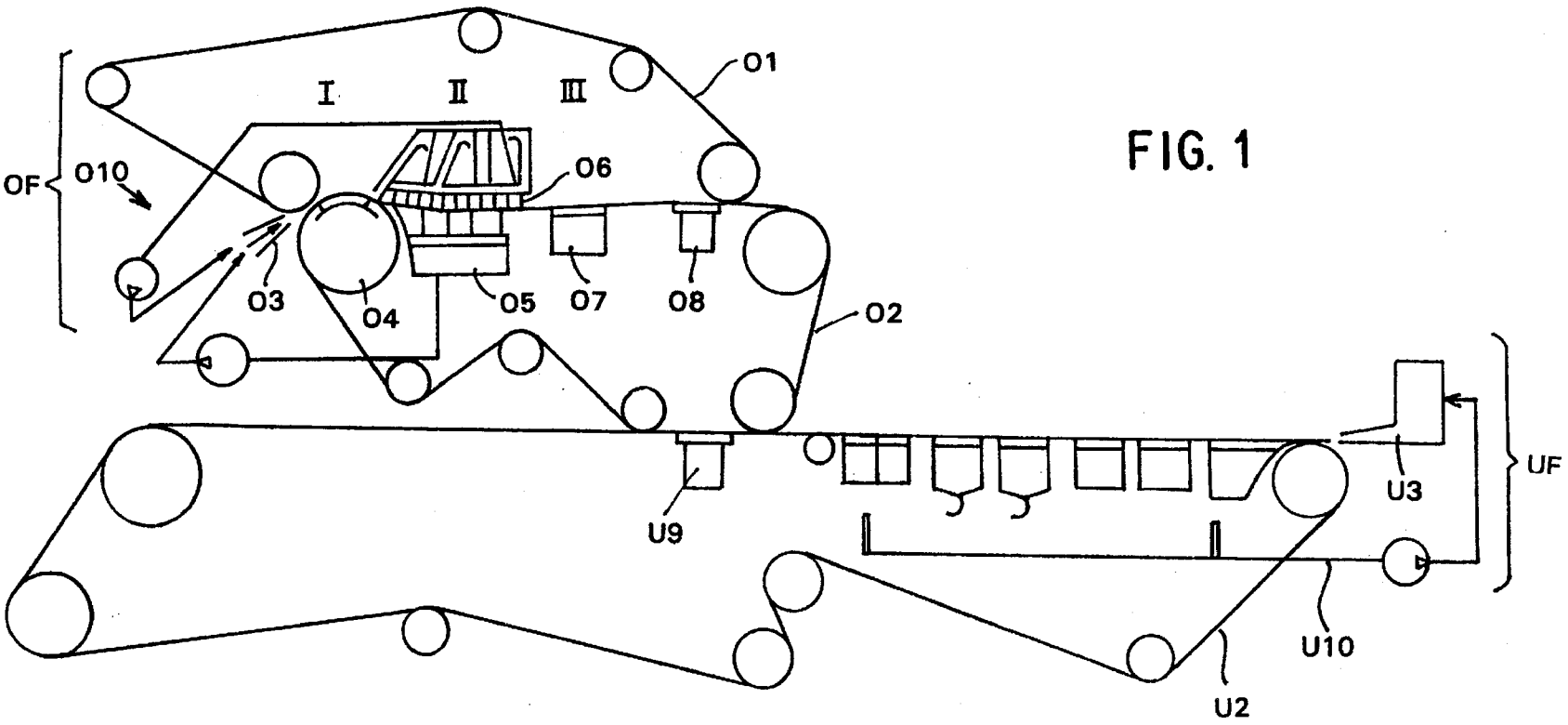
FIG. 1 is a schematic side view of a first embodiment of a combination of two web forming units.

FIG. 1 shows a combination of two web-forming units, comprising a first web-forming unit OF for forming an upper web layer and a second web-forming unit UF for forming a lower web layer and the two layers are couched together to form a fiber web.

The first upper web-forming unit OF is developed as a twin-wire former, as follows:

An upper wire and a lower wire 01 and 02 are guided over a number of respective guide rolls in respective endless wire loops. The pulp suspension discharged by a headbox 03 is enclosed in sandwich-like manner between the upper and lower wires. The lower wire 02 is conducted over a suction breast roll 04 at which the first part of the removal of the water takes place. This comprises section I of the twin-wire former.

The following second section, section II of the twin-wire former is comprised of a plurality of elastically pressable ledges within a suction box 05, as shown in U.S. Pat. Nos. 5,078,835 and 5,045,153 which is located within the lower wire 02, i.e. in the same wire loop as the breast roll 04. Opposite the resilient ledges, there is another suction box 06 in which a plurality of stationary drainage ledges are arranged, as shown in U.S. Pat. No. 5,045,153 and EP 0 489 094 B1, and which is contained within the wire loop of the upper wire.

In the following section III, there is another stationary drainage element 07 in the wire loop of the lower wire 02. Following this within section III, there is a wire-separating element 08 which assists in separating the upper wire from the lower wire with the layer of paper remaining on the lower wire.

For forming, for instance, a lower paper web layer, a hybrid former UF is provided. It includes an endless rotating wire loop belt U2. The fiber suspension for the, for instance, lower layer is fed by means of a lower headbox U3. Essentially, one-sided drainage takes place in the direction of gravity, supported by additional drainage units which are arranged in the loop of the endless wire belt U2, and these can act on the inner surface of the belt U2 in the region of the path of the fiber suspension.

The fiber web layer in the first or upper web-forming unit, following section III, is guided downward with the lower wire 02 over a guide roller, while the lower wire belt U2 continues to travel straight ahead (to the left) with the second fiber-web layer. The fiber web layer moving on the lower wire 02 comes into contact with the fiber web layer on the wire belt U2. Then the upper wire 02, supported by a further suction box U9, separates from the two fiber web layers which have been brought together between the two wires 02 and U2. Then the upper wire 02 is fed again via guide rollers to the twin-wire former. The wire belt U2 conducts the two layers of paper which have now been brought together further to the removal point of the press section and the lower wire U2 is then guided over several guide rollers back again to the headbox U3.

The final fiber web produced is comprised of two fiber web layers. The first, outer fiber web layer, which was produced with the twin-wire former, forms the outer surface to be a one-sided, high quality fiber web. The second fiber web layer, which has been produced with the hybrid former, has a larger number of fillers in the region of its outer surface than in the region of its boundary surface with the first fiber web layer.

Both formers or both web-forming units UF and OF have their own backwater circuits U10 and 010. The backwater recovered upon the drainage in the web-forming units can be fed again, untreated, to the respective headbox of the corresponding web-forming unit, since the collected backwater corresponds essentially to the properties of the suspension fed to each of the headboxes.

Figure 2:
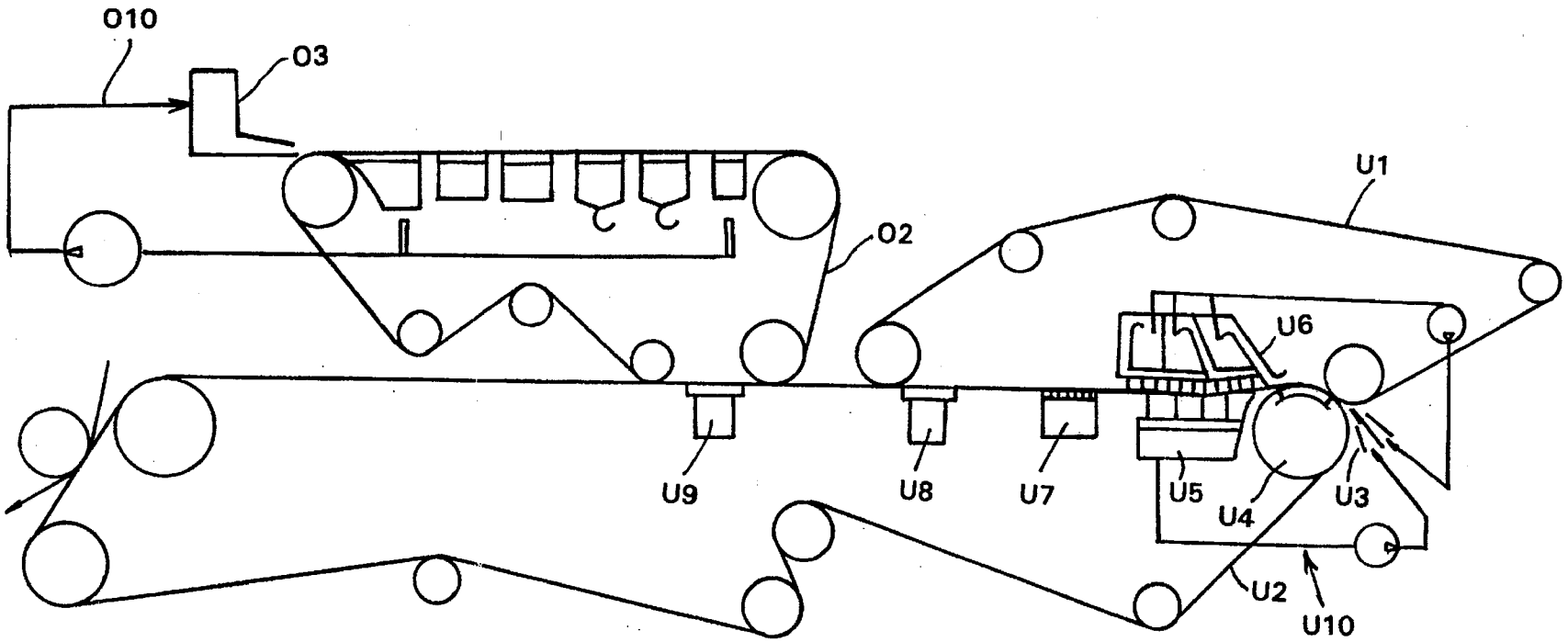
FIG. 2 is a schematic side view of a second such embodiment.

FIG. 2 shows a development that is similar to FIG. 1, but in this case the top and bottom arrangement of the two web-forming units is reversed. The fiber web produced thus has a high quality lower side. Here the twin wire former is on the bottom while the hybrid former is at the top. But once both layers are formed on their respective formers, the combined web is formed in the sandwich between the wires 02 and U2 and the top wire 02 is separated from the combined web layers and the web layers travel on the lower wire U2 as in the first embodiment.

The fiber webs shown in the embodiments of FIGS. 1 and 2 are of equivalent quality. Because of the advantageous properties of the twin-wire former used, it is substantially immaterial which of the two outer sides of the fiber web layer produced with such a twin-wire former forms, in the final analysis, the outer side of the fiber web produced. The two arrangements are thus equivalent. A substantial advantage of this combination, therefore, is that the arrangement of the formers can be optimally adapted in accordance with the existing conditions of use, and are not restricted in advance by corresponding limiting conditions as to the possibilities of arrangement.

Although the present invention has been described in relation to a particular embodiment thereof, many other variations and modifications and other uses will become apparent to those skilled in the art. For example in lieu of employing a hybrid former, a single wire former may be employed. It is preferred, therefore, that the present invention be limited not by the specific disclosure herein, but only by the appended claims.

What is claimed is:

1. In a paper-making machine for the manufacture of a multi-layer web of paper, a forming section including a first and a second web forming unit, each forming a respective layer of the multi-layer web;

the first web forming unit comprising:

an upper first web forming wire, and first wire guide elements in engagement with the first wire for guiding the first wire on a respective first path;

a lower second web forming wire, and second wire guide elements in engagement with the second wire for guiding the second wire on a respective second path;

the first and second guide elements being arranged to guide the first and second wires on a common horizontal wire path which is less than the entire length of the first and second paths, and at the respective common wire path, the first and second wires form a sandwich for the web;

a fast headbox having an outlet for dispensing pulp suspension between the first and second wires in the common wire path;

following the headbox in the common wire path, a first drainage section including a first drainage element at the second wire for draining from the web through the second wire;

said first drainage element is curved for the first and second wires to wrap around and includes a suction breast roll;

along the common wire path following the first drainage section, a second drainage section including opposing drainage ledges on opposite sides of the first and second wires in the common wire path, and including first drainage ledges on the side of the common wire path toward which the outwardly facing side of the web layer is formed, and second drainage ledges on the side of the common wire path on which the inwardly facing side of the web layer is formed, the first and second drainage ledges at the common wire path being arranged staggered with respect to each other in the direction of travel of the wires in the common wire path, the second drainage ledges being stationary ledges and the first drainage ledges being resiliently pressable;

along the common wire path, after the second section thereof, a third drainage section including a suction wire separating element at one side of the common wire path for causing the wires to separate and the web to stay with the second wire;

the second forming unit comprising:

a respective third web forming wire on which a web layer is formed, and third wire guide elements in engagement with the third wire for guiding the third wire on a respective third path;

the third wire being guided by the third guide elements and the second wire being guided by the second guide elements as to define a joint run path between the second and third wires at a location along the path of the second wire that is past the separation thereof from the first wire, for forming the multilayer web in the joint run path of the second and third wires; and a second headbox having an outlet for dispensing pulp suspension to the third wire before the joint run path.

2. The paper-making machine forming section of claim 1, further comprising a back water circuit at each of the first and second web forming units for collecting and returning to the first and second headboxes water and suspension that has been drained from the web forming units.

3. The paper-making machine forming section of claim 2, further comprising second drainage elements associated with the third wire and disposed along the path of the third wire between the second headbox and the joint run path of the second and third wires, and the second back water circuit collecting water and material drained by the second drainage elements.

4. The paper-making machine forming section of claim 2, further comprising suction means associated with at least the first ledges at the side of the first ledges above the first wire.

5. The paper-making machine forming section of claim 2, further comprising a flat drainage element in the third section of the common wire path and preceding the suction wire separating element.

6. The paper-making machine forming section of claim 2, wherein each of the first, second and third wires of each of the first and second web forming units comprises a respective endless loop supported by the respective guide elements therefor.

7. The paper-making machine forming section of claim 6, wherein the second web forming unit comprises a hybrid former.

8. The paper-making machine forming section of claim 2, wherein the second web forming unit comprises a hybrid former.

9. The paper-making machine forming section of claim 2 further comprising, in the first web forming unit, first drive means for driving the first wire and second drive means for driving the second wire to move lengthwise for carrying pulp suspension at least through the common wire path.

10. The paper-making machine forming section of claim 2, wherein the second guide elements guiding the second wire off the third wire such that the multilayer web thereafter travels on the third wire.

* * * * *